United States Patent [19]

Pryor et al.

[11] 4,160,474

[45] Jul. 10, 1979

[54] LUBRICATION IN DC CASTING OF COPPER BASE ALLOYS

[75] Inventors: Michael J. Pryor, Woodbridge; Derek E. Tyler, Cheshire, both of Conn.

[73] Assignee: Olin Corporation, New Haven, Conn.

[21] Appl. No.: 862,371

[22] Filed: Dec. 20, 1977

[51] Int. Cl.[2] ..... B22D 11/00

[52] U.S. Cl. ..... 164/73; 106/38.28; 164/418; 252/30; 427/135

[58] Field of Search ..... 164/73, 72; 249/115; 427/135, 133; 252/30; 106/38.28

[56] References Cited

U.S. PATENT DOCUMENTS 4,039,337 8/1977 Brown et al. ..... 106/38.28

*Primary Examiner*—Robert D. Baldwin

*Attorney, Agent, or Firm*—Victor A. DiPalma

[57] ABSTRACT

Improvements in the direct chill casting of copper base alloys such as the tin brasses, tin bronzes and those alloys which exhibit a liquidus-solidus temperature separation of at least 50° C. is brought about by utilizing boron nitride particles in the dressing material for the mold walls. These boron nitride particles may also be added to normally used molten metal covering material and utilized as a cover for said alloys in the casting process. The most effective results in casting are obtained when using the boron nitride particles in mold dressing form in conjunction with molten cover form.

27 Claims, No Drawings

LUBRICATION IN DC CASTING OF COPPER BASE ALLOYS

BACKGROUND OF THE INVENTION

DC or direct chill casting of copper base alloys presents its own special problems in the prevention of adhesion of the molten alloy to the casting mold walls during the process. In such a casting process, the casting mold walls are normally coated or "dressed" to prevent adhesion or welding of the molten copper base alloy to the walls and to also provide lubrication between the mold walls and the emerging solidifying ingot. Various coating or dressing materials have been utilized in the prior art and such materials have usually consisted of carbonaceous powders such as graphite in a carrier of oil, grease or alcohol. The particular carrier has aided in application of the dressing material to the mold walls but has usually played an insignificant role in providing desired lubrication properties to the mold. Various other materials such as long chain organic compounds have been utilized to provide lubrication between the molten metal and the mold walls but have not achieved great commercial success.

Among other materials which have been utilized as dressing materials in direct chill casting processes, various mixtures of boron compounds such as boric oxide, metaboric acid and hydrates of the boric acids have been utilized in U.S. Pat. No. 3,342,249. These materials, according to the patent, have been substituted for such materials as graphite and have provided desirable increases in lubricating properties to the casting process. This particular patent, however, nowhere discusses the use of other particular boron compounds and in particular the boron compound utilized in the present invention.

The present invention, therefore, includes the use of a particular boron compound as lubricating material in direct chill casting processes. The present invention also contemplates the use of this same material as a covering material for the molten metal within the mold used in such a process. Typical mold covering materials have consisted of the same type of carbonaceous powders as utilized in mold dressings and other materials such as molten salts have also been used for this purpose. During the casting process, this mold covering material passes between the casting mold walls and the solidifying ingot to provide some supplementation to the lubricating properties of the mold dressing material. Use of the various prior art materials provides an inherent disadvantage in the direct chill casting of alloys which exhibit wide freezing ranges. Such alloys are those which have at least a 50° C. temperature difference between the solidus temperature and the liquidus temperature. The solidification process for these types of alloys invariably leads to inverse segregation within the alloy, wherein the solute-rich low melting point liquids in the alloy flow out to the ingot surface and become deposited on the casting mold. This deposited material on the casting mold walls covers the mold dressing material and severely decreases its lubricating effect. This particular segregation in turn leads to tearing of the ingot shell and possible failure of the casting process.

It is therefore a principal object of the present invention to provide a mold dressing material which provides increased lubrication in direct chill casting processes.

It is a further object of the present invention to provide a material as aforesaid which is particularly useful for copper base alloys which have wide freezing temperature ranges.

It is yet a further object of the present invention to provide a material as aforesaid which is also useful as covering material for the molten metal within a direct chill casting process.

It is still another object of the present invention to provide a material as aforesaid which reduces tearing of the ingot shell within a direct chill casting process.

Further objects and advantages of the present invention will become apparent from a consideration of the following specification.

SUMMARY OF THE INVENTION

The present invention utilizes a high temperature resisting boron compound, and in particular boron nitride, as a mold dressing material in the direct chill casting of copper base alloys. The boron nitride is mixed with a carrier material and applied to the mold walls before the molten metal is placed within the mold. The boron nitride of the present invention is also quite useful as a covering material for the molten metal within the mold to prevent excessive oxidation of the molten metal and to supplement somewhat the lubrication effect of the mold dressing material.

DETAILED DESCRIPTION

The present invention utilizes a mixture of boron nitride powder in a carrier material as a mold dressing formulation and as a molten metal cover formulation. The boron nitride powder may be up to minus 350 mesh in size but submicron powder is preferred for improved lubricating properties. The boron nitride powder is added to carbonaceous powder based dressings to form the improved mold dressing of the present invention. A particularly useful mold dressing is formulated by blending a dispersion of boron nitride powder in isopropanol with a small fraction of a commercial dressing consisting of graphite particles in isopropanol. The isopropanol rapidly evaporates after application of this mold dressing and leaves a coating consisting of up to 90% boron nitride particles. The fine graphite particles within the dressing act as binding material to hold the boron nitride particles together on the mold walls.

The composition of the mold dressing should be such that after application and evaporation of the particular carrier base, the boron nitride content is between 50 and 99% by volume solids. The preferred boron nitride content is from 70 to 95% by volume. The balance of the mold dressing should be a material such as graphite or lampblack which will help to bond the boron nitride particles to the mold surface. In preparing a dispersion to apply the dressing to the mold walls, a carrier is required. Such a carrier is preferably isopropanol, which is commonly used in prior art mold dressing materials. Such a carrier will constitute 30 to 80% of the mold dressing and should be sufficient to provide a uniform dispersion or suspension of the boron nitride and other particulate material. It is preferable to apply multiple thin coats of the mold dressing to the mold walls rather than a single heavy coat of the dressing. Alternative binder materials may be substituted for the graphite or lampblack particles and other commercially available mold dressings may be appropriately thinned in order to provide a carrier base for the boron nitride particles.

The boron nitride particulate material utilized in the present invention is also quite useful as part of a molten metal covering material in the direct chill casting process. This covering material should contain from 5 to 50% by volume boron nitride particles and preferably 15 to 30% by volume. These particles may have the same size range as those utilized in the mold dressing formulation discussed above but submicron powdered material is preferred. This powdered material may be mixed with any commonly utilized powdered molten metal covering material, whether carbonaceous or otherwise. For example, various powdered material which may be mixed with the boron nitride powder may include lampblack, graphite, charcoal, fly ash, vermiculite or mixtures of any of these materials. It should be noted that molten salts are not desirable as part of the molten metal covering material and are not effective since they tend to flux the mold dressing material from the walls of the mold. The most preferred material to be mixed with the boron nitride powder as the molten metal covering material is lampblack particles.

It should further be noted that while mold dressings containing boron nitride and molten metal covers containing boron nitride may separately provide advantages in comparison to existing materials, the optimum lubrication results are obtained when using the boron nitride in mold dressing form in conjunction with the same material in molten metal cover form. The boron nitride material, whether utilized in a mold dressing or in a molten metal cover, or a combination of the two, provides a means of improving lubrication during the DC casting of copper base alloys. This material is particularly advantageous in the DC casting of tin bronzes, tin brasses and other copper base alloys which exhibit long freezing ranges. These other alloys will exhibit a liquidus-solidus temperature separation of at least 50° C. Use of the boron nitride material will provide ingot surfaces which are essentially free of hot tears and other defects which arise due to friction between the casting mold walls and the solidifying ingot. It has been found that use of boron nitride material essentially eliminates mold pickup of inversely segregated high solute phases. This last benefit contributes to the improved ingot surfaces and also greatly reduces the time needed to redress the mold walls between casting runs, thus lowering the overall operating costs for each run.

Further objects and advantages of the present invention will become more apparent from a consideration of the following illustrative examples.

EXAMPLE I

An alloy consisting essentially of 5.8% by weight Sn, 0.1% by weight P, 1.0% by weight Fe, 0.5% by weight Cr, balance Cu was cast in a direct chill mold covered with a suspension of graphite particles in isopropanol. The molten alloy was covered with powdered lampblack. The ingot emerged from the casting process with numerous hot tears in its surface and an examination of the mold walls after casting revealed a layer of tin-rich exudate over the mold dressing.

EXAMPLE II

The same alloy as utilized in Example I was cast in a direct chill casting mold which was coated with a mold dressing consisting of 10% by volume of the same graphite suspension in isopropanol as used in Example I, 22.5% by volume of submicron powdered boron nitride and 67.5% by volume of isopropanol. The molten metal covering material utilized in this example was a mixture of 20% by volume submicron boron nitride powder and 80% by volume lampblack. The ingot produced from this mold exhibited no hot tears on its surface and examination of the mold walls after casting revealed no evidence of a tin-rich exudate on the walls.

It can clearly be seen from these examples that the mold dressing and molten metal covering material of the present invention provides superior results in ingots produced in a direct chill casting process when compared to commonly utilized prior art material. The material of the present invention not only provides a better product but it also provides for a decrease in the time needed to redress the mold walls between casting runs. Therefore, the material of the present invention provides the greatly desirable combination of a higher quality product produced at less cost.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

We claim:

1. A composition which is particularly useful as a mold dressing material in the direct chill casting of copper base alloys, said composition consisting essentially of a dispersion of a combination of 50 to 99% by volume boron nitride particles, balance carbonaceous particles, in a volatile liquid carrier, wherein the carrier constitutes from 30 to 80% by volume of the dispersion.

2. A composition according to claim 1 wherein said volatile liquid is isopropanol.

3. A composition according to claim 1 wherein said boron nitride particles make up from 70 to 95% by volume of the particulate material in said dispersion.

4. A composition according to claim 1 wherein the size of said boron nitride particles is at least minus 350 mesh.

5. A composition according to claim 4 wherein the size of said boron nitride particles is submicron.

6. A composition according to claim 1 wherein said carbonaceous particles are selected from the group consisting of graphite and lampblack particles.

7. A covering material for molten metal in the direct chill casting of copper base alloys, said composition consisting essentially of from 5 to 50% by volume boron nitride particles, balance particulate material selected from the group consisting of lampblack, graphite, charcoal, fly ash, vermiculite, and mixtures thereof.

8. A composition according to claim 7 wherein the amount of boron nitride particles in said composition ranges from 15 to 30% by volume.

9. A composition according to claim 7 wherein said particulate material is lampblack.

10. A composition according to claim 7 wherein both said boron nitride particles and said particulate material are at least minus 350 mesh in size.

11. A composition according to claim 10 wherein both said boron nitride particles and said particulate material are submicron in size.

12. A method for casting copper base alloys which comprises:

(a) providing a molten mass of a copper base alloy selected from the group consisting of tin brasses, tin bronzes and those copper base alloys which exhibit a liquidus-solidus temperature separation of at least 50° C.;

(b) coating the inner mold walls of a casting mold with a dispersion of from 50 to 99% by volume boron nitride particles, balance carbonaceous particles, in a volatile liquid carrier which constitutes from 30 to 80% by volume of said dispersion;

(c) allowing said volatile liquid carrier to evaporate;

(d) placing said molten copper base alloy within said mold so that the molten alloy contacts the coated mold walls; and (e) casting said copper base alloy to ingot, wherein hot tears on the surface of said ingot are substantially reduced or eliminated.

13. A method according to claim 12 wherein the boron nitride content of the solids portion of said dispersion ranges from 70 to 95% by volume.

14. A method according to claim 12 wherein said volatile liquid carrier is isopropanol.

15. A method according to claim 12 wherein said carbonaceous particles are selected from the group consisting of lampblack and graphite particles.

16. A method according to claim 12 wherein said molten mass of copper base alloy is covered before being cast with a powder mixture consisting essentially of from 5 to 50% by volume boron nitride particles, balance particles selected from the group consisting of lampblack, graphite, charcoal, fly ash, vermiculite, and mixtures thereof.

17. A method according to claim 16 wherein the amount of said boron nitride particles in said powder mixture ranges from 15 to 30% by volume.

18. A method according to claim 16 wherein said powder mixture is a mixture of boron nitride particles and lampblack particles.

19. A method according to claim 16 wherein both said boron nitride particles and said carbonaceous particles are at least minus 350 mesh in size.

20. A method according to claim 19 wherein both said boron nitride particles and said carbonaceous particles are submicron in size.

21. In combination a mold for direct chill casting of copper base alloys and a mold dressing material coated on the inner walls of said mold, said dressing material consisting essentially of a dispersion of a combination of 50 to 99% by volume boron nitride particles, balance carbonaceous particles, in a volatile liquid carrier, wherein the carrier constitutes from 30 to 80% by volume of the dispersion.

22. A combination according to claim 21 wherein said volatile liquid is isopropanol.

23. A combination according to claim 21 wherein said boron nitride particles make up from 70 to 95% by volume of the particulate material in said dispersion.

24. A combination according to claim 21 wherein the size of said boron nitride particles is at least minus 350 mesh.

25. A combination according to claim 24 wherein the size of said boron nitride particles is submicron.

26. A combination according to claim 21 wherein said carbonaceous particles are selected from the group consisting of graphite and lampblack particles.

27. A composition according to claim 1 wherein said liquid is an organic volatile liquid.

* * * * *